United States Patent [19]
Natzel
[11] 4,194,266
[45] Mar. 25, 1980

[54] ADJUSTABLE ROLLER MECHANISM

[75] Inventor: Jerome W. Natzel, Owatonna, Minn.
[73] Assignee: Truth Incorporated, Owatonna, Minn.

[21] Appl. No.: 920,148
[22] Filed: Jun. 29, 1978
[51] Int. Cl.[2] ..... E05D 17/00
[52] U.S. Cl. ..... 16/99; 16/32; 16/DIG. 34; 16/DIG. 39
[58] Field of Search ..... 16/99, 100, 105, 106, 16/32, DIG. 34, DIG. 39; 74/805, 804, 393, 394

[56] References Cited

U.S. PATENT DOCUMENTS

| | | | |
|---|---|---|---|
| 2,940,113 | 6/1960 | Riser | 16/105 |
| 3,237,238 | 3/1966 | Anderson | 16/105 |
| 3,339,223 | 9/1967 | Laby | 16/105 |
| 4,059,197 | 11/1977 | Iida | 74/804 X |
| 4,134,178 | 1/1979 | Stevens | 16/105 |

*Primary Examiner*—C. J. Husar
*Assistant Examiner*—Moshe I. Cohen
*Attorney, Agent, or Firm*—Wegner, Stellman, McCord, Wiles & Wood

[57] ABSTRACT

An adjustable roller mechanism for a sliding closure having a case attachable to the sliding closure and a roller-mounting bracket mountable thereon for adjustable movement to varying positions extending from the case. A smooth surfaced cam is rotatably mounted to control the adjusted position of the roller bracket and a modified planocentric gear assembly operable by manually rotating a mounting shaft provides a gear reduction drive for rotation of the cam and for automatically locking the cam in any rotative position.

12 Claims, 5 Drawing Figures

ADJUSTABLE ROLLER MECHANISM

BACKGROUND OF THE INVENTION

This invention pertains to an adjustable roller mechanism for a sliding closure which provides for a smooth and precise vertical adjustment with a smooth rotational motion and which can be adjusted under load conditions and is automatically self-locking in any position of adjustment.

Prior patents show many different types of adjustable roller mechanisms for sliding closures or similar uses. U.S. Pat. No. 3,826,044, owned by the assignee of this application, shows such a structure with a pivotally-mounted roller bracket adjustable through the action of a rotatable threaded member acting against a cam.

U.S. Pat. No. 3,100,316 shows a pivotally-mounted roller bracket wherein the adjusted position of a pivoted roller bracket is controlled by a rotatable shaft having an eccentric.

U.S. Pat. No. 3,237,238 shows an adjustable roller assembly wherein a rotatable cam with a stepped surface provides for stepped adjustment of a roller bracket relative to a case and with the steps on the cam providing for locking of the cam at any one of said stepped positions.

None of the above patents provide an adjustable roller mechanism utilizing a smooth surfaced cam to permit precise vertical adjustment and the other advantages provided by the invention disclosed herein and as set forth below.

SUMMARY OF THE INVENTION

A primary feature of the invention disclosed herein is to provide an adjustable roller mechanism which provides for adjustable positioning of a roller bracket relative to a mounting case by use of a smooth cam member to provide precise vertical adjustment and which is self-locking in any position.

The smooth cam member is rotatably-mounted and because of the smooth surface thereof can be rotated to provide for precise vertical adjustment of the roller bracket and with the drive mechanism for rotating the cam in response to manual input including a gear reduction drive mechanism enabling adjustment while the roller mechanism is under load conditions.

More particularly, the adjustable roller mechanism includes a shaft rotatably mounted by the case and which rotatably mounts the cam and with the shaft having an eccentric for operation of a modified planocentric gear assembly whereby the amount of force required to rotate the cam is reduced. The design of the modified planocentric gear assembly can be chosen for different loads that may be encountered, dependent upon the load placed on the mechanism by the sliding closure and, further, the gear assembly is designed to provide a mechanism which can be economically produced by die casting of the parts.

An additional feature of the invention is to provide a structure for the case of the adjustable roller mechanism which enables the mechanism to carry greater loads without being damaged.

DESCRIPTION OF THE PREFERRED EMBODIMENT

Figure 1:
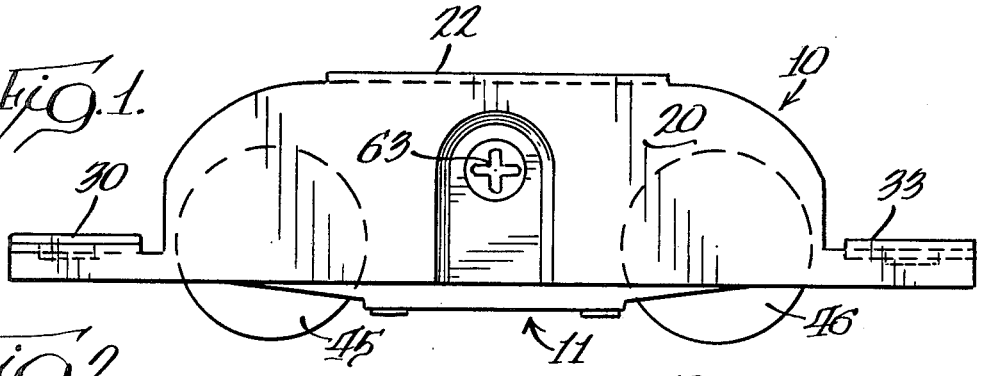
FIG. 1 is a side elevational view of the adjustable roller mechanism.
Figure 2:
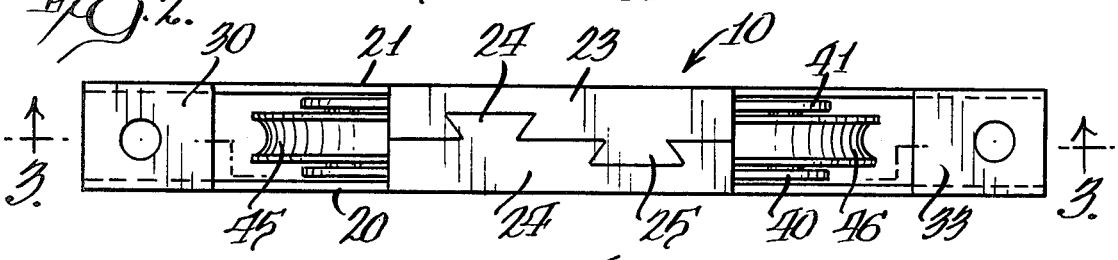
FIG. 2 is a plan view thereof.
Figure 3:
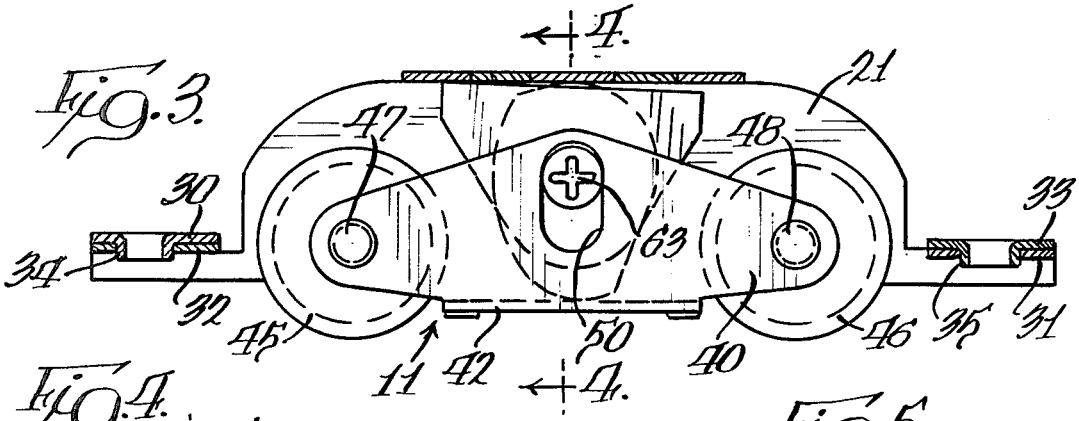
FIG. 3 is a vertical section, taken generally along the line 3—3 in FIG. 2.
Figure 4:
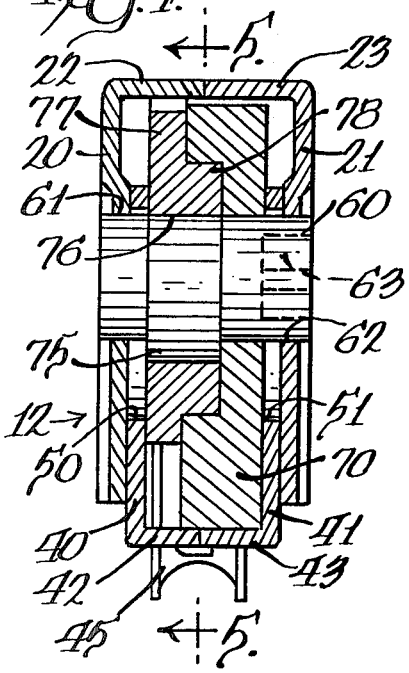
FIG. 4 is a transverse section, taken generally along the line 4—4 in FIG. 3 and on an enlarged scale.

The adjustable roller mechanism is shown generally in FIGS. 1 to 3 and comprises generally a case 10, roller bracket means 11 and gear drive and reduction means 12.

The case 10 is formed from a pair of planar members 20 and 21 in spaced-apart relation and which have a pair of flanges 22 and 23 extending inwardly at right angles one from the top of each of the planar members and interlocked by dovetail connections 24 and 25. Additionally, the planar members 20 and 21 each have a tab at each end extending inwardly at right angles from the planar member to overlie a tab extending inwardly from the other member. The planar member 21 has the tabs 30 and 31 and the planar member 20 has the tabs 32 and 33, as shown particularly in FIG. 3. Each pair of overlapped tabs has an opening to receive a fastening member for attaching the roller mechanism to a sliding closure and with each of the uppermost tabs 30 and 33 having a part 34 and 35, respectively, struck downwardly to form a staked interlock with the underlying tab. The interlocked tab structure as well as the dovetail interlock structure provide a strong sturdy case for withstanding substantial loading.

The roller bracket means includes a pair of planar bracket members 40 and 41 in spaced-apart parallel relation and with inturned interconnected flanges 42 and 43, respectively, at the bottom thereof. The roller bracket means carries one or more track-engaging rollers with the embodiment shown having a pair of rollers 45 and 46 positioned between the bracket members 40 and 41 and rotatably mounted by means of rivets 47 and 48, respectively, which interconnect the bracket members as well as define axles for the rollers.

Each of the bracket members 40 and 41 has a vertically extending slot 50 and 51, respectively, which provide for adjustable movement of the roller bracket means relative to the case to control the extent to which the rollers 45 and 46 are positioned outwardly of the case. The elongate slots 50 and 51 receive a rotatable shaft 60 which is rotatably-mounted in a pair of openings 61 and 62 in the planar members 20 and 21 of the case and which has a tool-receiving socket 63 at one end thereof.

In addition to guiding the roller bracket means, the rotatable shaft 60 provides a manually-applied power input means for adjusting the position of the roller bracket means relative to the case.

The position of the roller bracket means relative to the case is controlled by a rotatable cam 70 which is rotatably-mounted on the shaft 60 and which has a smooth cam surface 71 for engaging against an inner surface 72 of the inturned flanges 42 and 43 of the roller bracket means. Rotation of the cam 70 is through a gear drive mechanism powered by rotation of the shaft 60. This mechanism includes an eccentric 75 on the shaft 60 which fits within an opening 76 of a substantially stationary gear member 77. The gear member 77 has a cylindrical section 78 provided with an external series of gear lobes 80. Additionally, the gear member 77 has a pair of surfaces 81 and 82 which selectively engage with the underside of the case flange 22 during rotation of the cam 70.

The cam 70 has an internal opening surrounding the cylindrical section 78 of the stationary gear and which is formed with an internal series of gear lobes 85 which are of a total number different than the external gear lobes 80. This structure provides a modified planocentric gear mechanism having a gear reduction capability and with one revolution of the manual input shaft 60 resulting in only a one gear lobe rotation of the cam 70. Rotation of the input shaft 60 results in the eccentric 75 imparting a slight amount of movement to the substantially stationary gear 77 and which is also restrained by intermesh of the gear lobes whereby, in the example shown, one revolution of the shaft 60 results in only a small rotary advance of the cam 70.

Figure 5:
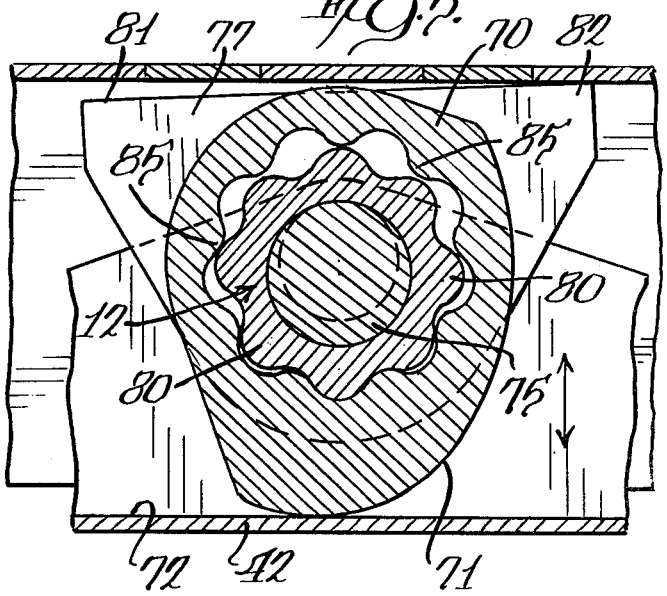
FIG. 5 is a vertical section, taken generally along the line 5—5 in FIG. 4.

As shown in FIG. 5, the rotatable cam 70 is in a position to provide maximum extension of the roller bracket means relative to the case and with clockwise rotation of the cam 70 the smooth cam surface 71 will be moved to permit movement of the roller bracket means relatively inwardly into the case 10.

From the foregoing description, it will be evident that the roller mechanism can be adjusted precisely with a smooth rotational motion and under load conditions. Additionally, the mechanism is self-locking in any position of the rotatable cam 70, since any load force applied against the cam 70 is transmitted to a gear lobe mesh which is directly in line with the point of applied force and the axis of rotation of the shaft 60.

Further, the adjustable roller mechanism has the parts designed for economic production by die casting of the gear mechanism and for strength in use because of the unitary nature of the case.

I claim:

1. An adjustable roller mechanism for a sliding closure comprising, a housing, a shaft rotatably mounted in said housing, roller bracket means having roller means associated with said housing and movable transversely to the axis of rotation of said shaft, a cam rotatably mounted on said shaft and having a smooth, continuous cam surface engageable with said roller bracket means whereby said cam in different rotative positons causes different positions of extension of said roller bracket means relative to said housing, and gear reduction drive means operable for rotating said cam in response to rotation of said shaft.

2. A mechanism as defined in claim 1 wherein said gear reduction drive means comprises a modified planocentric gear assembly.

3. A mechanism as defined in claim 1 wherein said gear reduction drive means comprises an eccentric on said shaft, a member mounted on said eccentric and confined to limited movement within said housing and having a generally cylindrical section with a series of gear lobes, and an opening in said cam surrounding said member section and having gear lobes of a different number than said series and coacting therewith.

4. An adjustable roller mechanism for a sliding closure comprising, a case attachable to the sliding closure, roller bracket means guided on the case for movement toward and away from a guide track and having at least one roller engageable with said guide track, and means for adjusting the position of the roller bracket means relative to the case including a rotatable shaft, a rotatable cam coaxial with and rotatable on said rotatable shaft, and drive means interconnecting said shaft and cam to have one revolution of said shaft cause a partial revolution of said cam.

5. An adjustable roller mechanism including a roller mounting member, a mounting attachable to a closure, means movably mounting said member on the mounting and for adjustment relative thereto, a cam rotatably mounted on said mounting and having a smooth cam surface engageable with the member to control the adjusted position of the member relative to the mounting, and automatically operable means including structure disposed interiorly of the cam to retain said cam in any desired rotative position.

6. A mechanism as defined in claim 5 wherein said automatically operable means comprises a planocentric type gearing.

7. A mechanism as defined in claim 5 wherein a rotatable shaft on said mounting mounts said member and has an eccentric, and gear means operable by said eccentric as the shaft is rotated for causing rotation of said cam.

8. A mechanism as defined in claim 7 wherein said gear means includes reduction gear means whereby one revolution of said shaft causes a partial revolution of said cam.

9. A mechanism as defined in claim 5 wherein said case includes a pair of generally planar members in spaced-apart relation and interconnected into a unitary structure by means including a pair of interlocked flanges extending at right angles one from each planar member and with overlapped tabs at the ends of the planar members provided with a mounting hole therethrough and staked together.

10. An adjustable roller mechanism for a sliding closure comprising, a case attachable to the sliding closure, a manually-operable shaft rotatably mounted in said case, a roller bracket movably mounted on said shaft for adjusting movement outwardly of said case, a cam rotatably mounted on said shaft and having a cam surface engageable with said roller bracket for positioning of the latter, and means for causing rotational movement of the cam including an eccentric on said shaft, a substantially stationary gear member fitted on said eccentric, said gear member having a cylindrical section with a series of external gear lobes, and said cam having an internal opening surrounding said section and a series of internal gear lobes of a different number than the external gear lobes.

11. A mechanism as defined in claim 10 wherein said case includes a pair of generally planar members in spaced-apart relation and interconnected into a unitary structure by means including a pair of flanges extending at right angles one from each planar member and with said flanges interconnected by dovetail connections.

12. An adjustable roller mechanism for a sliding closure comprising, a case attachable to the sliding closure, a manually-operable shaft rotatably mounted in said case, a roller bracket movably mounted on said shaft for adjusting movement outwardly of said case and carrying a pair of rollers, a cam rotatably mounted on said shaft and having a cam surface engageable with said roller bracket for positioning of the latter, and means for causing rotational movement of the cam including an eccentric on said shaft, a substantially stationary gear member fitted on said eccentric, said gear member having a pair of surfaces selectively engageable with said case and a cylindrical section with a series of external gear lobes, and said cam having an internal opening surrounding said section and a series of internal gear lobes of a different number than the external gear lobes whereby rotation of said shaft causes slight movement of the substantially stationary gear member as restrained by the case and the cam to cause cam rotation and one gear lobe mesh occurs along a line between the axis of rotation of said shaft and the point of engagement between the cam surface and said roller bracket to lock the cam against inadvertent rotation.

* * * * *